US005811914A

United States Patent [19]

Eijkens

[11] Patent Number: 5,811,914

[45] Date of Patent: Sep. 22, 1998

[54] ELECTRODELESS LOW-PRESSURE DISCHARGE LAMP

[75] Inventor: Willy L. G. Eijkens, Turnhout, Belgium

[73] Assignee: U.S. Philips Corporation, New York, N.Y.

[21] Appl. No.: 834,407

[22] Filed: Apr. 16, 1997

[30] Foreign Application Priority Data

Apr. 19, 1996 [EP] European Pat. Off. ..... 96201061

[51] Int. Cl.[6] ..... H01J 65/04

[52] U.S. Cl. ..... 313/51; 315/248; 313/161

[58] Field of Search ..... 313/51, 161, 234, 313/607; 315/248, 344

[56] References Cited

U.S. PATENT DOCUMENTS 5,694,000 12/1997 Antonis et al. ..... 313/234

FOREIGN PATENT DOCUMENTS

0625794A1 11/1994 European Pat. Off. .

*Primary Examiner*—Sandra L. O'Shea
*Assistant Examiner*—Vip Patel

[57] ABSTRACT

An electrodeless low-pressure discharge lamp according to the invention comprises a light-transmitting discharge vessel which is provided with an ionizable filling. The discharge vessel has a cavity in which an electric coil is arranged which is provided with a primary and a secondary winding around a metal body, the primary winding of the coil being connected to a first and a second electrical conductor of a cable for connection to a first and a second output terminal of a high-frequency supply the second output terminal of the supply being free from high-frequency voltage variations relative to ground (M). The secondary winding is connected at one of its ends to the second electrical conductor and has a further, free end. The electrical conductors are electrically insulated from one another, the second electrical conductor surrounding the first electrical conductor. The metal body is capacitively coupled to the second electrical conductor. A reduction in electromagnetic interference fields is realized thereby in a simple manner.

6 Claims, 2 Drawing Sheets

ELECTRODELESS LOW-PRESSURE DISCHARGE LAMP

BACKGROUND 0F THE INVENTION

The invention relates to an electrodeless low-pressure discharge lamp comprising a light-transmitting discharge vessel which is provided with an ionizable filling and which has a cavity in which an electric coil is arranged which is provided with a primary and a secondary winding around a metal body, the primary winding of the coil being connected to a first and to a second electrical conductor of a cable for connection to a first and a second output terminal, respectively, of a high-frequency supply, which second output terminal of the supply is free from high-frequency voltage variations relative to ground, the secondary winding being connected with one of its ends to the second electrical conductor and having a further, free end, which electrical conductors are electrically insulated from one another, the second electrical conductor surrounding the first electrical conductor.

Such a lamp is known from Ep 625 794 A1. A magnetic field which maintains an electric discharge in the discharge space is generated by a primary winding of the coil of the lamp during lamp operation. The first and the second electrical conductor from the output terminals of the high-frequency supply to the coil are formed by a core and a sheath, respectively, of a coax cable. For simplicity's sake, the item "electrical conductor" is also referred to as "conductor" hereinafter. The term "high-frequency" in the present description and planes is understood to be a frequency higher than 20 kHz. The coil is provided around a core of soft magnetic material in which the metal body, which acts as a heat conductor, is accommodated. A voltage gradient which is opposed to that in the primary winding is generated in the secondary winding, which is connected at one end to the sheath of the coax cable. High-frequency variations in the voltage averaged over the coil surface are reduced thereby, and thus the strength of the electric field caused by the lamp. Nevertheless, narrow tolerances are to be observed during installation of the lamp as regards the mutual positions of the lamp, the supply, and the cable, and the reflector in which the lamp is fastened with its flanged end portion must be grounded so as to ensure that the strength of the electric field caused by the lighting unit remains below the value of 40 dB$\mu$V/m as stipulated in EN 55022.

SUMMARY OF THE INVENTION

It is an object of the invention to provide a lamp of the kind described in the opening paragraph which allows the user a greater freedom in installation. According to the invention, the lamp of the kind described in the opening paragraph is for this purpose characterized in that the metal body is capacitively coupled to the second conductor. It was found that the strength of the electromagnetic field is considerably reduced in this embodiment of the lamp, which renders possible a widening of the tolerance limits for lamp installation. A capacitive coupling obtains between the coil and the metal body which is inherent in their mutual positioning. It is assumed that the capacitive coupling between the second conductor and the metal body on the one hand and the capacitive coupling between the coil and the metal body on the other hand together cause parasitic currents to occur between the coil and the second conductor, whereby the amplitudes of high-frequency variations in the voltage averaged over the coil surface are reduced.

The capacitive coupling between the second conductor and the metal body may be formed, for example, by a capacitor between these components. A favorable embodiment of the lamp according to the invention, however, is one which is characterized in that the metal body is connected to a third conductor which is electrically insulated from the first and second conductors and which forms a part of the cable which surrounds the second conductor. A capacitive coupling between the metal body and the second conductor is obtained by means of such a cable without a separate component being necessary. If so desired, the third conductor may be grounded near the supply. A reduction in electromagnetic interference is found to be realized, however, also without grounding of this conductor.

In a favorable embodiment, the second and the third conductor of the cable form a capacitive impedance with a value which lies between 200 and 1,000 pF/m. A comparatively long cable between the lamp and the supply is necessary for obtaining a sufficient reduction in electromagnetic interferences in the case of a value below 200 pF/m. For realizing a value above 1,000 pF/m, comparatively expensive materials are necessary for the cable.

The metal body around which the coil is provided may be, for example, a constructive element at the same time and/or serve as a heat conductor for removing heat from the cavity of the discharge vessel. The coil of the lamp may have, for example, a cylindrical core of soft magnetic material in a cavity of which the metal body is provided. Alternatively, for example, the coil may have one or several rods of soft magnetic material which are provided in respective cavities of the metal body. In yet another embodiment, a core of soft magnetic material is absent.

The ionizable filling of the discharge vessel may comprise besides an inert gas, for example a rare gas such as argon, also a component able of evaporation, for example mercury or sodium. The discharge vessel may be provided with a luminescent layer for converting UV radiation generated in the discharge space into visible radiation.

The second and the third conductor may be, for example, layers of braided metal fibers. A favorable embodiment of the electrodeless low-pressure discharge lamp according to the invention is characterized in that the second and the third conductor comprise a foil and a core, the foil surrounding the first conductor and making electrical contact with the core. It is sufficient for obtaining a reliable electrical contact when the core and the foil extend against one another in the cable. The core, which comprises one or several metal fibers, may extend, for example, parallel to the first conductor, but may alternatively be coiled. On the one hand, the foil forms a large surface area so that a good capacitive coupling between the second and third conductors may be easily obtained. On the other hand, the core allows of an easy fastening to an output terminal of a supply or to a contact of a winding, which simplifies lamp installation further.

In a favorable embodiment, the third conductor is clamped against the metal body. An electrical connection between the third conductor and the metal body is thus realized in a convenient manner.

It is favorable when the first and the second conductor of the cable extend jointly through a cylindrical body of soft magnetic material adjacent the lamp. This contributes to a reduction in higher harmonics of the voltage imposed on the mains by the supply unit.

The lamp according to the invention is suitable for use in a lighting unit according to the invention which in addition comprises a supply unit with a first and a second output terminal, the first output terminal supplying a high-frequency voltage and the second output terminal being free from high-frequency voltage variations relative to ground, while the first and the second conductor of the cable are connected to the first and the second output terminal, respectively, of the supply unit.

BRIEF DESCRIPTION OF THE DRAWINGS

These and other aspects of the invention will be explained in more detail below with reference to the drawing in which.

DETAILED DESCRIPTION OF THE PREFERRED EMBODIMENTS

Figure 1:
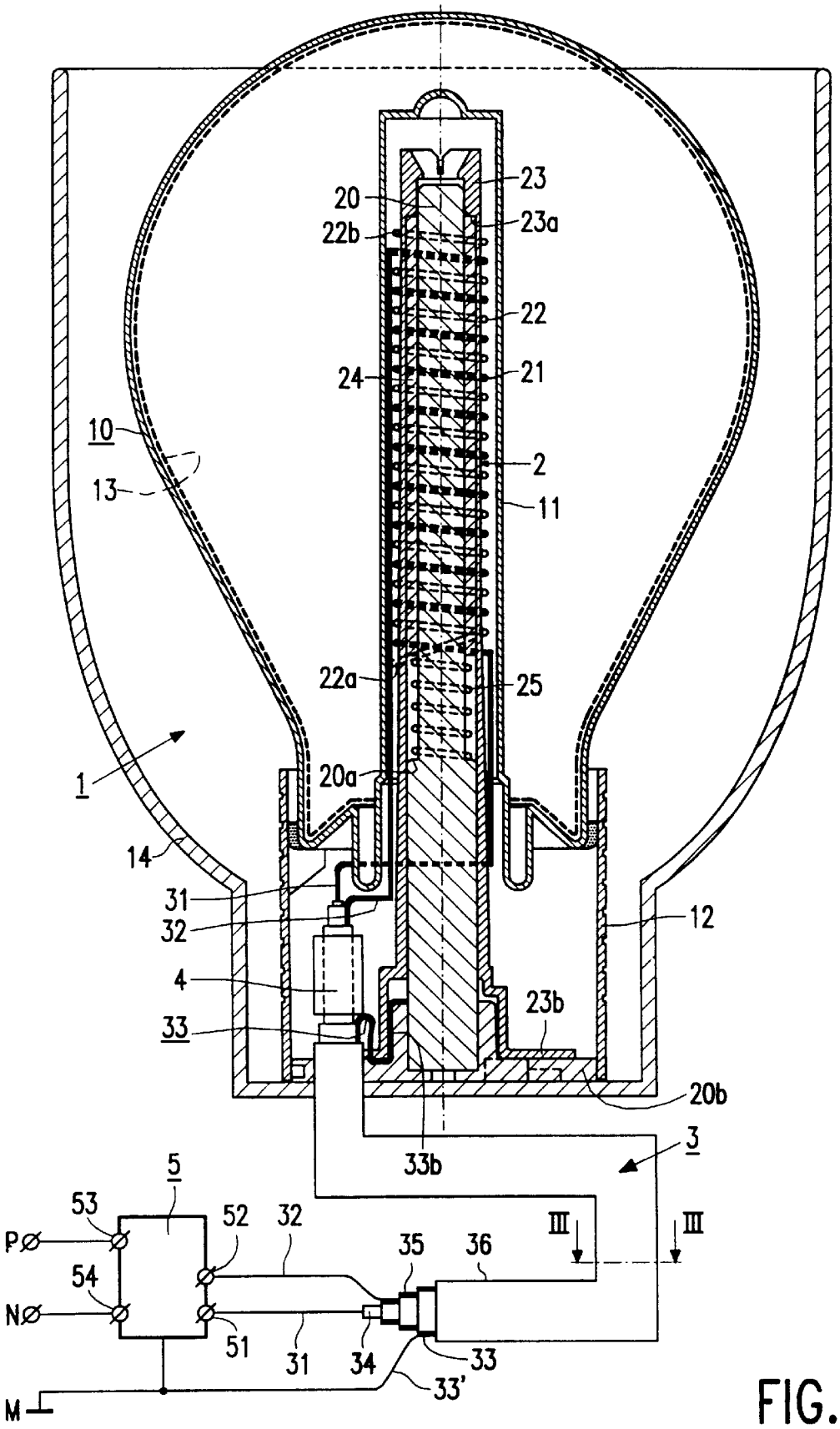
FIG. 1 shows an embodiment of the electrodeless low-pressure discharge lamp according to the invention in longitudinal sectional view, with a supply unit shown diagrammatically.

FIG. 1 shows an electrodeless low-pressure discharge lamp 1 with a light-transmitting discharge vessel 10 which is fastened to a collar 12. The discharge vessel 10 is provided with an ionizable filling, here a filling of mercury and a rare gas. The discharge vessel 10 has a luminescent layer 13 on an internal surface. An electric coil 2 is accommodated in a cavity 11 of the discharge vessel 10 and is provided with a primary and a secondary winding 21, 22 around a metal body 20. The coil 2 is provided around a synthetic resin coil former 23. The metal body 20, which acts as a heat conductor at the same time, extends through a core 24 of soft magnetic material which is accommodated in the coil former 23. A helical spring 25 is in addition arranged around the metal body 20 in the extended direction of the core 24, bearing on a widened portion 20*a* of the metal body 20 and keeping the core 24 pressed against a narrowed portion 23*a* of the coil former 23. This construction keeps the core 24 fixed in the coil former irrespective of dimensional fluctuations occurring during manufacture, so that variations in the characteristics of the coil 2 are reduced. The primary winding 21 of the coil 2 is connected to a first and to a second conductor 31, 32 of a cable 3. The second conductor 32 surrounds the first conductor 31 which is electrically insulated from the second by a first insulating sheath 34. The secondary winding 22 is also connected to the second conductor 32 at a first end 22*a* and has a second, free end 22*b*. The lamp 1 forms part of a lighting unit which further comprises a supply unit 5, the first and the second conductor 31, 32 being connected to a first and a second output terminal 51, 52, respectively, of the supply unit 5. The supply unit 5 also has input terminals 53, 54 for connection to poles P, N of the mains. The cable 3 between the lamp 1 and the supply 5 has a length of 50 cm. During operation of the supply unit 5, there is a high- frequency voltage difference between the output terminals 51, 52, the second output terminal 52 being free from high-frequency voltage variations relative to ground M. The second output terminal 52, however, need not be electrically neutral relative to ground, and may show, for example, a low-frequency voltage variation, for example derived from the mains. The metal body 20 is capacitively coupled to the second conductor 32. In the embodiment shown, the capacitive coupling between the metal body 20 and the second conductor 32 is realized in that the metal body 20 is connected to a third conductor 33 which is electrically insulated from the first and the second conductor 31, 32, the third conductor 33 forming part of the cable 3 and surrounding the second conductor 32. The cable 3 has a second insulating sheath 35 between the second and third conductors 32, 33. The third conductor 33, which itself is surrounded by a third insulating sheath 36, is connected to ground M at an end 33'.

Figure 2:
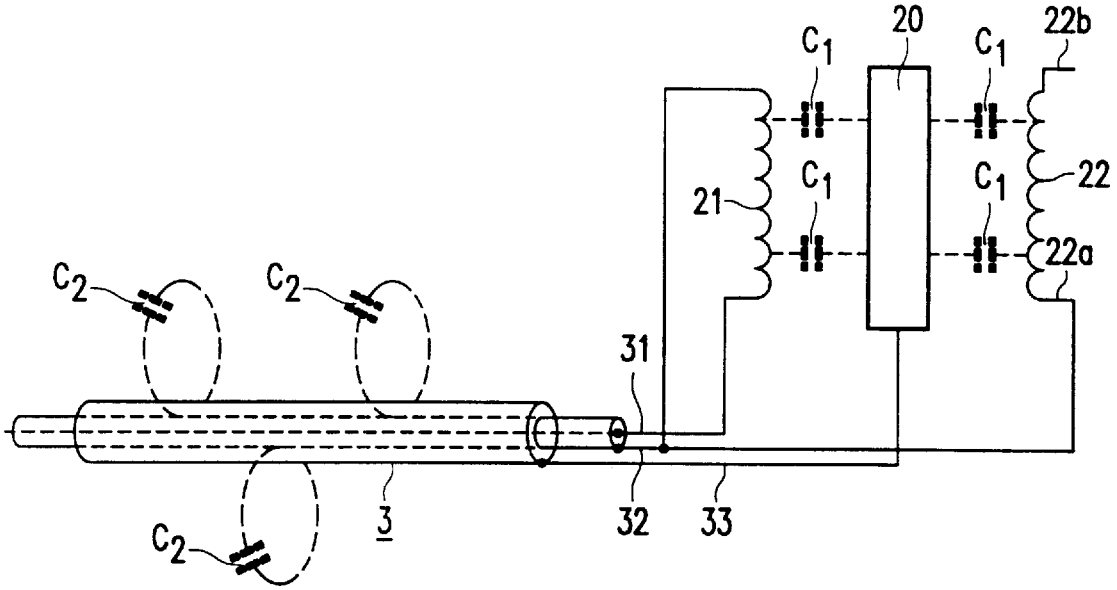
FIG. 2 is a circuit diagram in conjunction with the cable and the coil of the lamp of FIG. 1.

FIG. 2 shows how the coil 2 and the second conductor 32 are capacitively coupled via parasitic capacitance C1 between the coil 2 and the metal body 20 in the coil on the one hand and via the capacitance C2 between the third conductor 33, electrically connected to the metal body, and the second conductor on the other hand.

Figure 3:
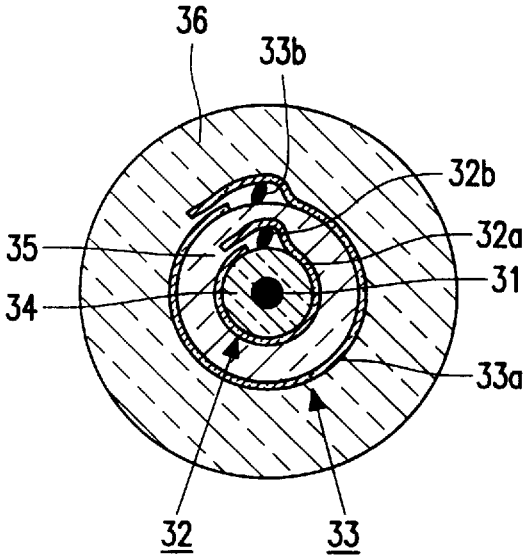
FIG. 3 is a cross-section taken on the line III—III in FIG. 1.

The second and third conductors 32, 33 each comprise a foil 32*a*, 33*a* and a core 32*b*, 33*b*, the relevant foil 32*a*, 33*a* extending around the first conductor 31 and making electrical contact with the relevant core 32*b*, 33*b* (see FIG. 3). The insulating sheaths 34, 35, 36 are made from PVC. The capacitance per unit length between the second and the third conductor is 360 pF/m, and accordingly lies between the limits of 200 and 1,000 pF/m mentioned earlier.

In the embodiment shown, the third conductor 33 is clamped against the metal body 20. The core 33*b* of the third conductor 33 is here clamped in between a flange-shaped widening 23*b* of the coil former 23 and a body 20.

The first and the second conductor 31, 32 extend through a cylindrical body 4 of soft magnetic material adjacent the lamp 1. The cylindrical body 4 in this case has a length of 7 mm and an internal and external diameter of 2.5 and 5 mm, respectively. The lamp 1 is positioned in a metal reflector 14. A flanged end portion 20*a* of the metal body 20 is screwed to the reflector 14, so that the reflector 14 is also connected to the third conductor 33.

A lighting unit was also manufactured, provided with a lamp not according to the invention and differing from the lighting unit according to the invention in that the third conductor does not form part of the cable comprising the first and the second conductor but is formed by a metal strip with a width of 2 cm, the cable being fastened parallel to and against the strip. The first and second conductors form a core and a sheath, respectively, of the cable.

The electric field was measured in accordance with EN 55022 both for the lighting unit according to the invention and for the lighting unit not according to the invention. A value of 30 dB$\mu$V/m was measured for the lighting unit according to the invention, which is 5 dB$\mu$V/m lower than in the case of the lighting unit not according to the invention: 35 dB$\mu$V/m. When the third conductor was not connected to ground M in the lighting unit according to the invention, a lower value: 34 dB$\mu$V/m was still measured as compared with the lighting unit not according to the invention.

A lighting unit according to the invention was also manufactured, again with a cable of 50 cm, where the capacitance between the second and the third conductor of the cable was 900 pF/m. The second and the third conductor of the cable of this lighting unit according to the invention were mutually insulated by means of a sheath of polyester foil. It was found that the use of this cable did not result in a significant further reduction in the electromagnetic interference compared with the embodiment of the invention described with reference to FIG. 1.

I claim:

1. An electrodeless low-pressure discharge lamp (1) comprising a light-transmitting discharge vessel (10) which is provided with an ionizable filling and which has a cavity (11) in which an electric coil (2) is arranged which is provided with a primary (21) and a secondary winding (22)

around a metal body (20), the primary winding (21) of the coil being connected to a first (31) and to a second electrical conductor (32) of a cable (3) for connection to a first (51) and a second output terminal (52), respectively, of a high-frequency supply unit (5), which second output terminal (52) of the supply unit (5) is free from high-frequency voltage variations relative to ground (M), the secondary winding (22) being connected by one of its ends (22*a*) to the second electrical conductor (32) and having a further, free end (22*b*), which electrical conductors (31,32) are electrically insulated from one another, the second electrical conductor (32) surrounding the first electrical conductor (31), characterized in that the metal body (20) is capacitively coupled to the second electrical conductor (32).

2. An electrodeless low-pressure discharge lamp as claimed in claim 1, characterized in that the metal body (20) is connected to a third conductor (33) which is electrically insulated from the first and second conductors 31,32) and which forms a part of the cable (3) which surrounds the second electrical conductor (32).

3. An electrodeless low-pressure discharge lamp as claimed in claim 2, characterized in that the second and the third electrical conductor (31,32) of the cable (3) form a capacitive impedance with a value which lies between 200 and 1,000 pF/m.

4. An electrodeless low-pressure discharge lamp as claimed in claim 2, characterized in that the second and the third electrical conductor (32,33) each comprise a foil (32*a*, 33*a*) and a strand (32*b*,33*b*), the foil surrounding the first electrical conductor (31) and making electrical contact with the corresponding strand.

5. An electrodeless low-pressure discharge lamp as claimed in claim 4, characterized in that the third electrical conductor (33) is clamped against the metal body (20).

6. An electrodeless low-pressure discharge lamp as claimed in claim 1, characterized in that the first and the second electrical conductor (31,32) of the cable (3) extend jointly through a cylindrical body (4) of soft magnetic material adjacent the lamp (1).

* * * * *